US005907465A

United States Patent [19]

Easter

[11] Patent Number: 5,907,465

[45] Date of Patent: May 25, 1999

[54] CIRCUIT FOR ENERGIZING EAS MARKER DEACTIVATION DEVICE WITH DC PULSES OF ALTERNATING POLARITY

[75] Inventor: Ronald B. Easter, Parkland, Fla.

[73] Assignee: Sensormatic Electronics Corporation, Boca Raton, Fla.

[21] Appl. No.: 09/133,529

[22] Filed: Aug. 13, 1998

[51] Int. Cl.[6] ..... G08B 13/14

[52] U.S. Cl. ..... 361/149; 361/189; 361/155; 361/156; 340/572

[58] Field of Search ..... 361/149, 143, 361/155, 153, 156, 267, 150, 189; 340/572, 551; 307/113, 112, 115, 116

[56] References Cited

U.S. PATENT DOCUMENTS 5,254,974 10/1993 Rebers et al. ..... 340/572

5,493,275 2/1996 Easter ..... 340/572

5,499,156 3/1996 Bentley ..... 361/150

5,781,111 7/1998 Easter et al. ..... 340/572

*Primary Examiner*—Jeffrey Gaffin

*Assistant Examiner*—Kim Huynh

*Attorney, Agent, or Firm*—Robin, Blecker & Daley

[57] ABSTRACT

A device for deactivating magnetomechanical EAS markers includes a storage capacitor and a coil for generating a deactivation field. A bridge arrangement of four switches interconnects the coil with the storage capacitor and with circuit ground. The switches are controlled to apply a train of DC pulses to the coil such that the pulses have alternating polarities and decreasing amplitudes.

20 Claims, 7 Drawing Sheets

(CIRCUIT 22 OUTPUT)

(CIRCUIT 24 OUTPUT)

(CURRENT APPLIED TO COIL)

CIRCUIT FOR ENERGIZING EAS MARKER DEACTIVATION DEVICE WITH DC PULSES OF ALTERNATING POLARITY

FIELD OF THE INVENTION

This invention relates generally to electronic article surveillance (EAS), and pertains more particularly to so-called "deactivators" for rendering EAS markers inactive.

BACKGROUND OF THE INVENTION

It has been customary in the electronic article surveillance industry to apply EAS markers to articles of merchandise. Detection equipment is positioned at store exits to detect attempts to remove active markers from the store premises, and to generate an alarm in such cases. When a customer presents an article for payment at a checkout counter, a checkout clerk either removes the marker from the article, or deactivates the marker by using a deactivation device provided to deactivate the marker.

Known deactivation devices include one or more coils that are energizable to generate a magnetic field of sufficient amplitude to render the marker inactive. One well known type of marker (disclosed in U.S. Pat. No. 4,510,489) is known as a "magnetomechanical" marker. Magnetomechanical markers include an active element and a bias element. When the bias element is magnetized in a certain manner, the resulting bias magnetic field applied to the active element causes the active element to be mechanically resonant at a predetermined frequency upon exposure to an interrogation signal which alternates at the predetermined frequency. The detection equipment used with this type of marker generates the interrogation signal and then detects the resonance of the marker induced by the interrogation signal. According to one known technique for deactivating magnetomechanical markers, the bias element is degaussed by exposing the bias element to an alternating magnetic field that has an initial magnitude that is greater than the coercivity of the bias element, and then decays to zero. After the bias element is degaussed, the marker's resonant frequency is substantially shifted from the predetermined interrogation signal frequency, and the marker's response to the interrogation signal is at too low an amplitude for detection by the detecting apparatus.

In one conventional deactivation device, a drive circuit occasionally applies a drive signal having a decaying AC waveform to a coil or coils. The drive circuit is triggered to generate the drive signal in response to a button or switch actuated by the checkout clerk, or by circuitry which detects the presence of an active marker.

More recently, in co-pending patent applications that are commonly assigned with the present application, it has been proposed to eliminate the triggering mechanism and to drive the deactivation device coil or coils with a continuous wave AC sinusoid having constant amplitude (or a periodically interrupted version of such a signal), as disclosed in application Ser. No. 08/794,012, filed Feb. 3, 1997; or with discrete single cycles of an AC sinusoid, also with constant peak amplitudes, as disclosed in application Ser. No. 09/110,508, filed Jul. 6, 1998. In the case of both of these coil excitation schemes, the required decay in the signal actually applied to the EAS marker is accomplished by sweeping the marker past the deactivation coils so that the field applied to the marker is attenuated as the marker exits the region in which the field is radiated.

The disclosures of the '012 and '508 patent applications are incorporated herein by reference.

Although sweeping markers past the deactivation device coils can work quite effectively, it is sometimes desirable to provide a deactivation device which does not require the marker to be swept. An example of such a deactivation device is the so-called "bulk" deactivator disclosed in U.S. Pat. No. 5,781,111. (The '111 patent has a common inventor and a common assignee with the present application, and the disclosure thereof is incorporated herein by reference.)

In addition, enhanced energy efficiency is another desirable goal for marker deactivation devices.

OBJECTS AND SUMMARY OF THE INVENTION

It is a primary object of the present invention to provide an efficient energizing circuit for an EAS marker deactivation device.

It is a further object of the invention to provide an energizing circuit which makes the deactivation device convenient to use.

According to an aspect of the invention, there is provided an apparatus for deactivating a magnetomechanical EAS marker, the apparatus including a coil for generating a magnetic field to which the marker is to be exposed, the coil having a first terminal and a second terminal, a storage capacitor, a first switch connected between the storage capacitor and the first terminal of the coil, a second switch connected between the second terminal of the coil and ground, a third switch connected between the storage capacitor and the second terminal of the coil, a fourth switch connected between the first terminal of the coil and ground, and control circuitry for controlling the first, second, third and fourth switches and causing the first and second switches to be open and the third and fourth switches closed during a first sequence of time intervals, and causing the third and fourth switches to be open and the first and second switches closed during a second sequence of time intervals interleaved with the first sequence of time intervals, and causing all of the first, second, third and fourth switches to be open during a third sequence of time intervals, a respective one of the third sequence of time intervals intervening between each sequential pair of intervals of the first and second sequences. Preferably, the respective durations of the intervals of the first and second sequences are both monotonically decreasing over the course, respectively, of the first and second sequences. The control circuit preferably includes a circuit for generating a ramp signal and a comparison circuit for comparing a signal level at the coil with the ramp signal, and circuitry responsive to the comparison circuit for selectively terminating the intervals of the first and second sequences. At least one additional coil may be connected in series or in parallel with the aforementioned coil. The time intervals of the third sequence, corresponding to "dead periods" between the intervals of the first and second sequences in which the coil is driven, are preferably much longer in duration than the intervals of the first and second sequences, which are quite short. Consequently, the effective duty cycle of the deactivation device is very low, so that power consumption is low.

According to another aspect of the invention, there is provided a method of deactivating a magnetomechanical EAS marker, the method including the steps of providing a coil, applying a sequence of first DC pulses to the coil, the first pulses all being of a first polarity, applying a sequence of second DC pulses to the coil, the second pulses being interspersed in time with the first pulses and of a second polarity opposite to the first polarity, and exposing the EAS marker to a magnetic field formed by the pulses in the coil. Preferably both the first pulses and the second pulses monotonically decrease in amplitude over a common time interval.

The foregoing and other objects, features and advantages of the invention will be further understood from the following detailed description of preferred embodiments and practices thereof and from the drawings, wherein like reference numerals identify like components and parts throughout.

DESCRIPTION OF PREFERRED EMBODIMENTS AND PRACTICES

Figure 1:
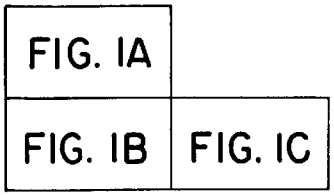
FIG. 1 is formed of FIGS. 1A, 1B and 1C, which together constitute a schematic diagram of a deactivation coil energizing circuit provided in accordance with the teachings of the present invention.

A first embodiment of the invention will now be described, with reference to FIG. 1, which is a schematic circuit diagram composed of FIGS. 1A–1C.

Figure 1A:
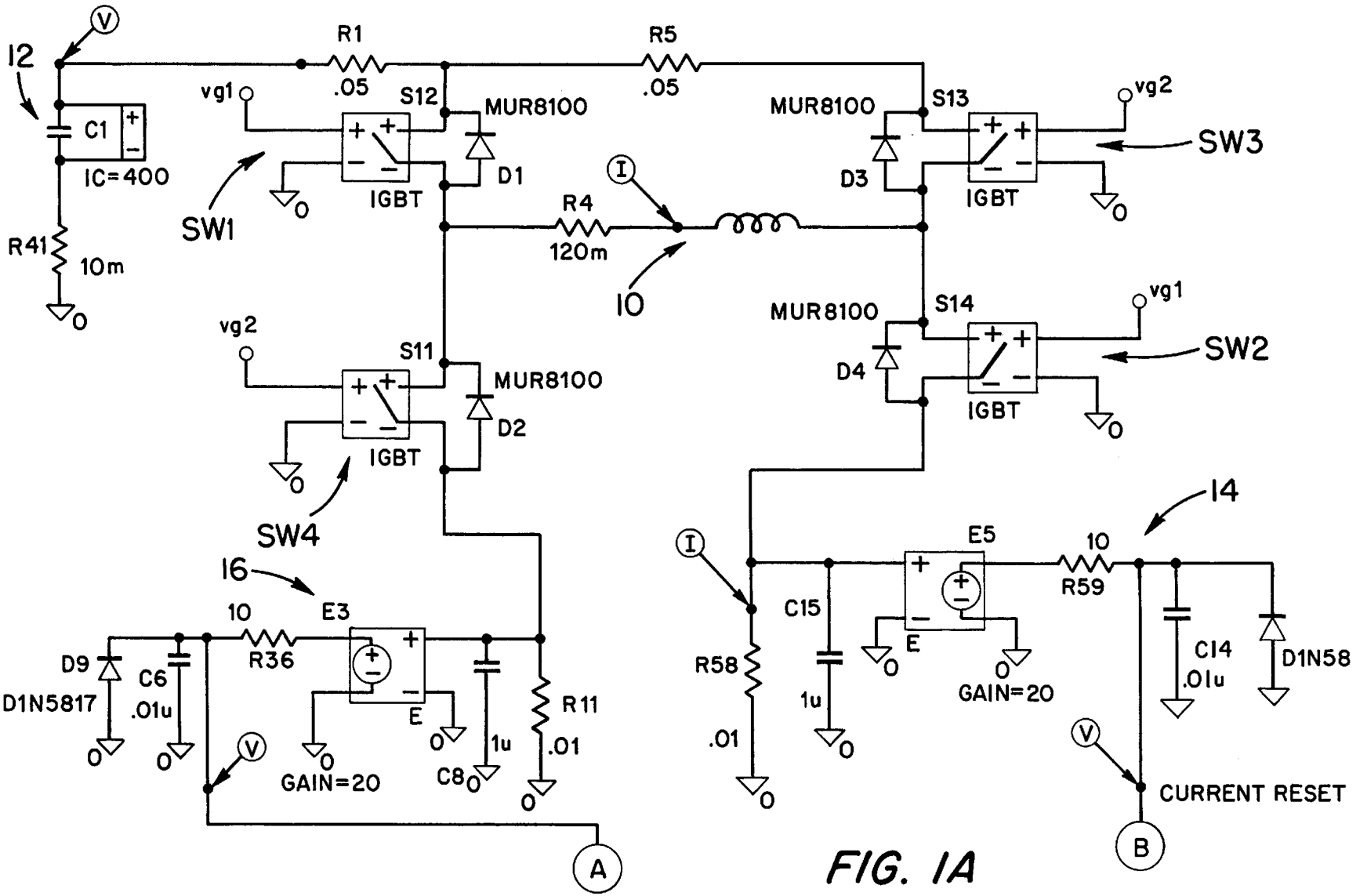
Figure 6B:
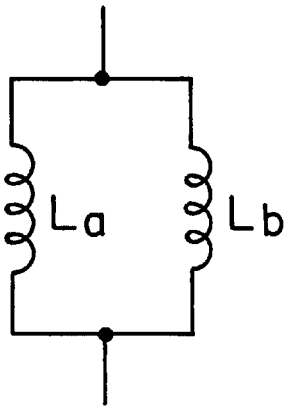
FIGS. 6A and 6B illustrate alternative coil arrangements that may be utilized in the circuit of FIG. 1.
Figure 6A:
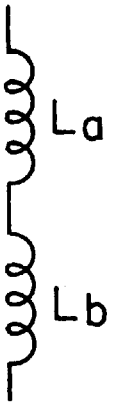

Indicated by reference numeral 10 in FIG. 1A is a coil installed in a marker deactivation device and selectively energized for the purpose of generating a magnetic field to which magnetomechanical EAS markers are to be exposed for deactivation. Although only one coil is indicated at reference numeral 10, it should be understood that two or more coils may be employed, connected in series (as shown in FIG. 6A) or in parallel with each other (as shown in FIG. 6B).

Also indicated in the circuitry of FIG. 1A is a bulk storage capacitor 12. According to a preferred embodiment of the invention, the capacitor 12 has a rating of 1,000 microfarads, although larger or smaller capacitors, or a bank of capacitors, may alternatively be employed.

Connected between the capacitor 12 and a first terminal of the coil 10 is a first transistor switch SW1. A second transistor switch SW2 is connected between a second terminal of the coil 10 and ground.

A third transistor switch SW3 is connected between the capacitor 12 and the second terminal of the coil 10; and a fourth transistor switch SW4 is connected between the first terminal of the coil 10 and ground. In the drawing, all four of the transistor switches are shown as being constituted by insulated-gate bipolar transistors (IGBT's); however, other types of transistors, such as MOSFET's, may be used. Other kinds of switching elements may be employed as alternatives to transistor switches.

A first current sense circuit 14 is connected to the coil 10 by way of switch SW2. At times when switch SW2 is in a closed condition, the current sense circuit 14 converts a current level present in the coil 10 into a voltage level to be provided to a control circuit that will be described below. Also shown in FIG. 1A is a second current sense circuit 16, connected to the coil 10 by way of switch SW4. The current sense circuit 16 provides to the control circuit a voltage level which represents the current level in the coil 10 at times when the switch SW4 is in a closed condition.

As will be seen, the control circuit controls the respective states of the transistor switches SW1 through SW4 such that a sequence of DC pulses, of alternating polarity, are applied to the coil 10, with the pulses declining in amplitude over time to generate a signal field which substantially degausses the bias element of a magnetomechanical marker positioned near the coil.

Figure 1B:
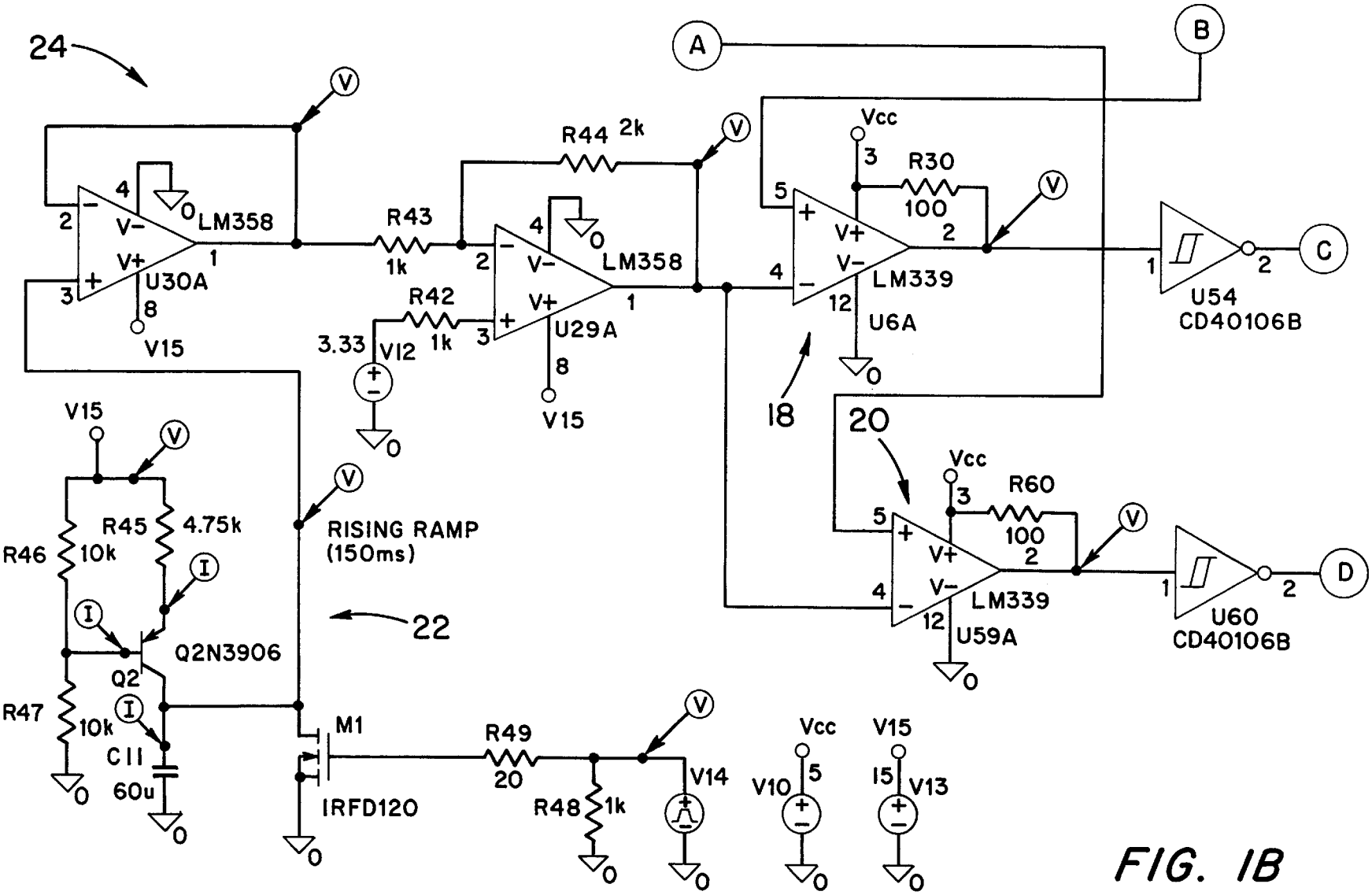
Figure 1C:
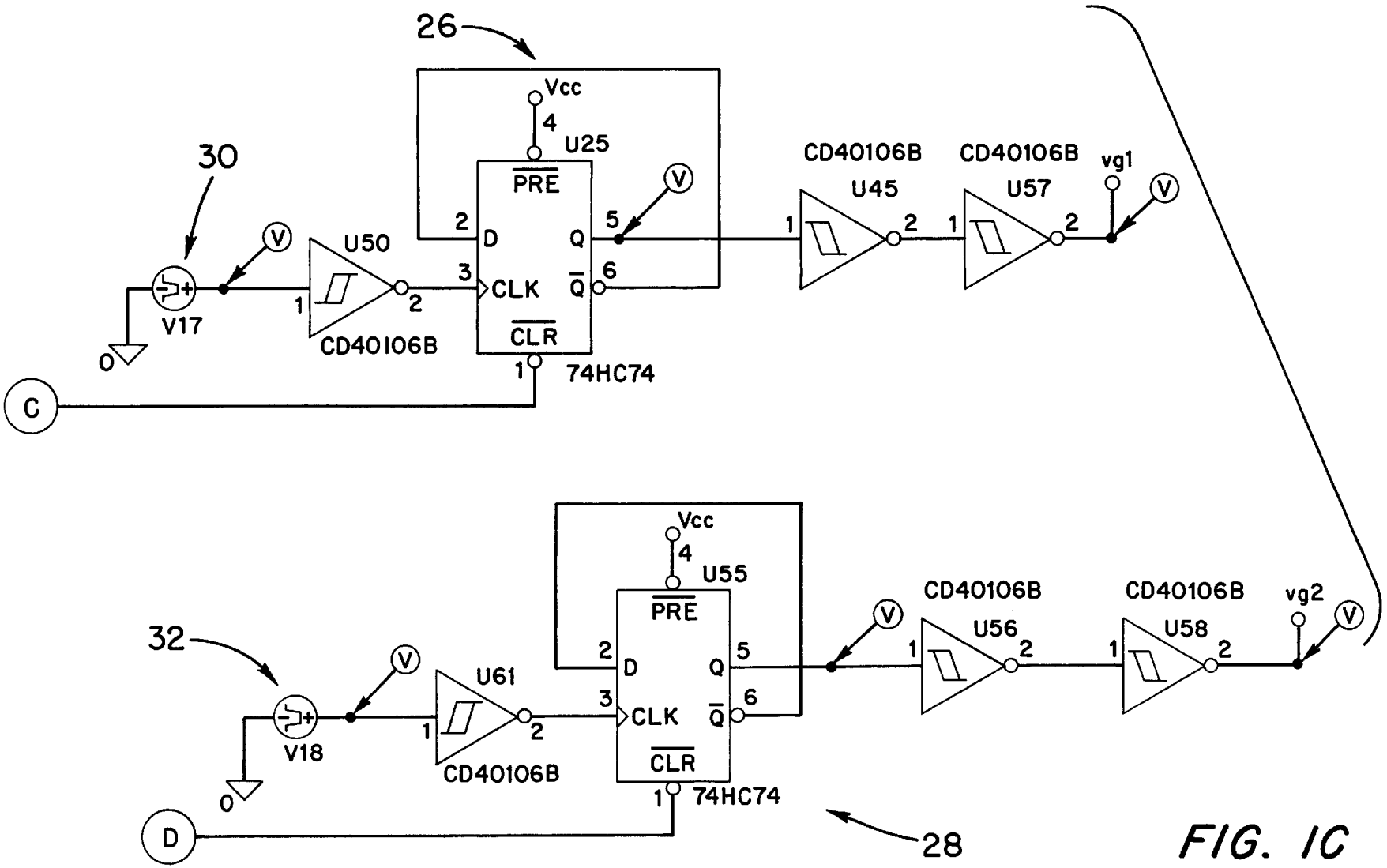

The control circuit which generates the control signals applied to the switches SW1 through SW4 is illustrated in FIGS. 1B and 1C.

Referring initially to FIG. 1B, the current sense signal output from the current sense circuit 14 is applied to the non-inverting input of a first comparator 18. Also, the current sense signal output by the current sense circuit 16 is applied to the non-inverting input of a second comparator 20.

A circuit indicated at 22 in FIG. 1B produces an output signal having a rising ramp waveform. The rising ramp signal is level shifted and inverted by a circuit 24 to form an output signal having a declining ramp waveform. The declining ramp signal is provided in parallel to the respective inverting inputs of the comparators 18 and 20. The output signals of the comparators 18 and 20 are applied to "clear" inputs of a first D-type flip-flop 26 (FIG. 1C) and of a second D-type flip-flop 28, respectively. A first clock signal indicated at 30 is applied to the "clock" input of the flip-flop 26. A second clock signal, indicated at 32, is applied to the "clock" input of the flip-flop 28. In a preferred embodiment of the invention, both clock signals are at substantially 500 Hz, and are substantially 180° out of phase with each other.

In the case of each of the flip-flops 26, 28, the respective inverted output thereof is connected to the "D" input of the respective flip-flop. The non-inverted output of the flip-flop 26 is provided in parallel as a control signal to the switches SW1 and SW2. The non-inverted output of the flip-flop 28 is provided in parallel as a control signal to the switches SW3 and SW4. Consequently, switches SW1 and SW2 are effectively ganged together under control of flip-flop 26, and switches SW3 and SW4 are effectively ganged together under control of flip-flop 28. When the output of flip-flop 26 is at a "high" logic level, the switches SW1 and SW2 are in a closed condition; at all other times switches SW1 and SW2 are maintained in an open condition. When the output of flip-flop 28 is at a "high" logic level, the switches SW3 and SW4 are in a closed condition; at all other times switches SW3 and SW4 are maintained in an open condition.

Operation of the circuit of FIG. 1 will now be described, with reference to FIGS. 2–4.

Figure 2A:
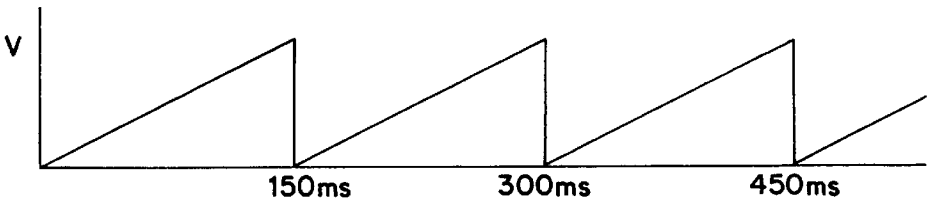
FIGS. 2A, 2B, 3A–3E and 4 are all waveform diagrams which are indicative of signals present at respective portions of the circuit of FIG. 1.
Figure 2B:
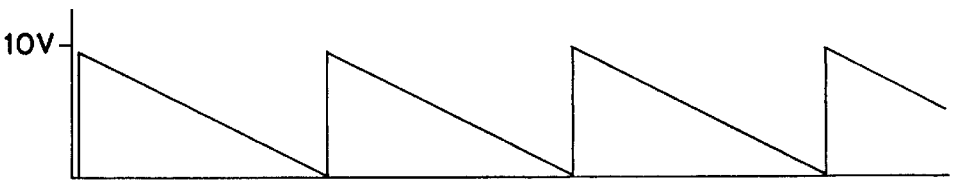

FIGS. 2A and 2B share a common horizontal scale, which is shown explicitly in FIG. 2A. FIG. 2A illustrates a repeated rising ramp waveform generated by the circuit 22 of FIG. 1B. FIG. 2B illustrates a repeated declining ramp signal generated by the circuit 24 and applied in parallel to the inverting inputs of the comparators 18 and 20.

Figure 3A:
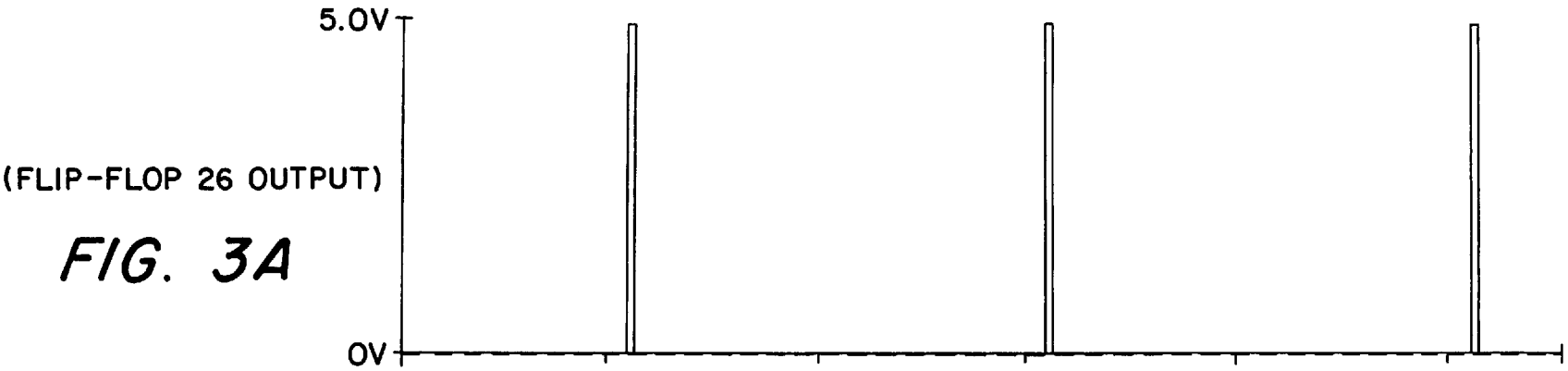
Figure 3B:
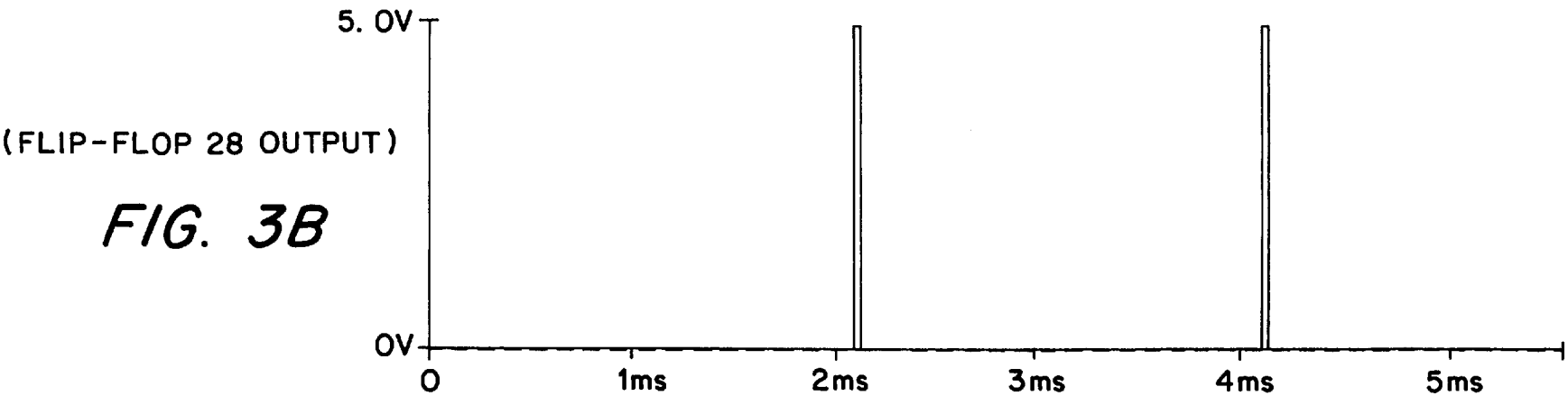
Figure 3C:
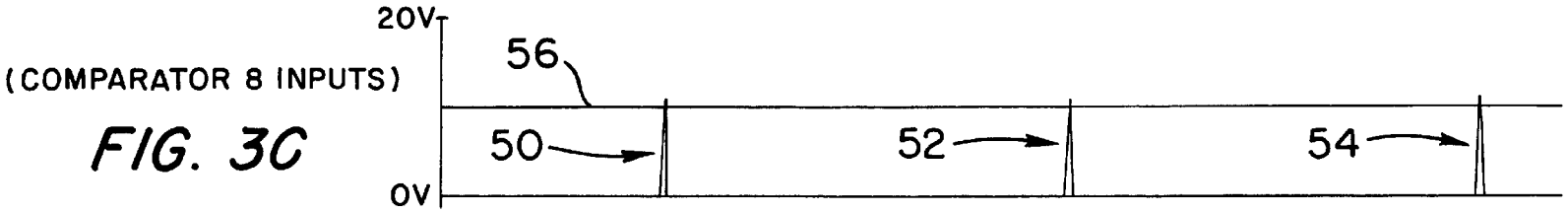
Figure 3D:
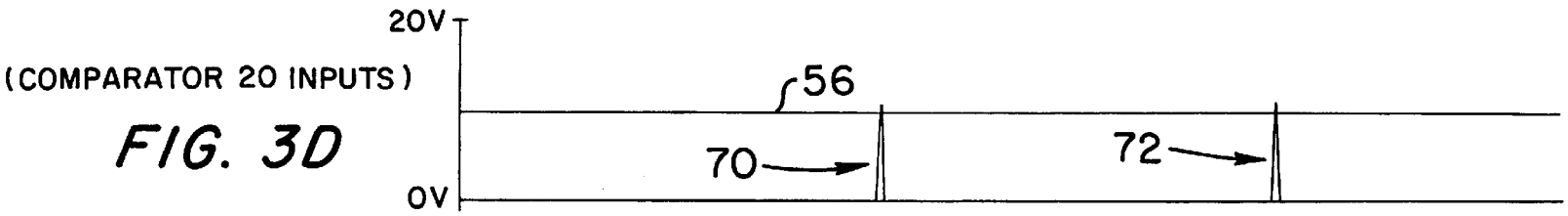

FIGS. 3A–3E all have a common horizontal scale, which corresponds to a time period of about 5 milliseconds (the gradations for the shared horizontal scale are explicitly shown only in FIG. 3B).

FIG. 3A shows a waveform indicative of the output of flip-flop 26. The waveform of FIG. 3A is a series of brief pulses. Since the output of flip-flop 26 is the control signal for switches SW1 and SW2, the brief periods during which the signal of FIG. 3A is at a "high" logic level correspond to the times when the switches SW1 and SW2 are in a closed condition. At all other times switches SW1 and SW2 are in an open condition. The timing at which each pulse of FIG. 3A begins corresponds to a rising edge of the 500 Hz clock signal applied to the flip-flop 26. Consequently, the pulses shown in FIG. 3A begin at intervals of substantially 2 milliseconds. The timing at which each pulse of FIG. 3A ends is set by a rising edge of the output signal of comparator 18, applied to the "clear" terminal of flip-flop 26. The timing of the output of the comparator 18, in turn, depends on the relationship between the respective levels of the declining ramp signal applied to the inverting input of the comparator 18, and the current sense signal applied to the non-inverting input of the comparator 18.

During the brief intervals when the output of the flip-flop 26 is at a high level, the switches SW1 and SW2 are closed, allowing a DC pulse to be applied to the coil 10 from the capacitor 12 in the direction from the switch SW1 to the switch SW2. These current pulses are indicated at 40, 42 and 44 in FIG. 3E, which illustrates the signal waveform of the current in coil 10, with the current flow direction from switch SW1 to switch SW2 being taken as the positive polarity. Corresponding current sense pulses output from the current sense circuit 14 are indicated at 50, 52 and 54 in FIG. 3C. It will be recalled that these current sense signal pulses are provided as input signals to the non-inverting input of the comparator 18. The signal trace 56 shown in FIG. 3C corresponds to the declining ramp signal supplied to the inverting input of the comparator 18. The points of intersection of the pulses 50, 52, 54 with the declining ramp signal trace 56 are indicative of the timings at which the control signal pulses of FIG. 3A are terminated by the comparison output signal from the comparator 18. It will be recognized that, as the level of the declining ramp signal decreases, the duration of the control signal pulses output from the flip-flop 26 decreases, as does the peak amplitude of the DC current pulses sequentially applied to the coil 10.

FIG. 3B is indicative of the control signal output from flip-flop 28 to control the switches SW3 and SW4. The timings of the beginnings of the pulses shown in FIG. 3B are determined by the rising edges of the 500 Hz clock applied to flip-flop 28. Thus the pulses in FIG. 3B commence at intervals of 2 milliseconds, and the pulse train shown in FIG. 3B is at a 180° phase offset from the pulse train of FIG. 3A. It will also be noted that, between each pulse of FIG. 3A and the next succeeding pulse of FIG. 3B, there is an intervening period which is substantially longer in duration than the respective durations of either of the pulses.

During the brief intervals when the control signal from the flip-flop 28 is at a "high" logic level, the switches SW3 and SW4 are closed, so that a DC current signal is induced in the coil 10 from the storage capacitor 12 in the direction from switch SW3 to switch SW4. The negative polarity pulses shown in FIG. 3E at 60 and 62 are indicative of these current pulse signals. The corresponding current sense voltage levels output from the current sense circuit 16 and provided as input signals to the non-inverting input of comparator 20, are indicated at 70, 72 in FIG. 3D. In FIG. 3D the trace 56 again represents the declining ramp signal, which as noted before is input to the inverting input of the comparator 20. Thus the intersections of the pulses 70, 72 with the trace 56 determine the timings of the ends of the control signal pulses of FIG. 3B, which in turn control the termination of the negative-sense current pulses applied to the coil 10.

Figure 4:
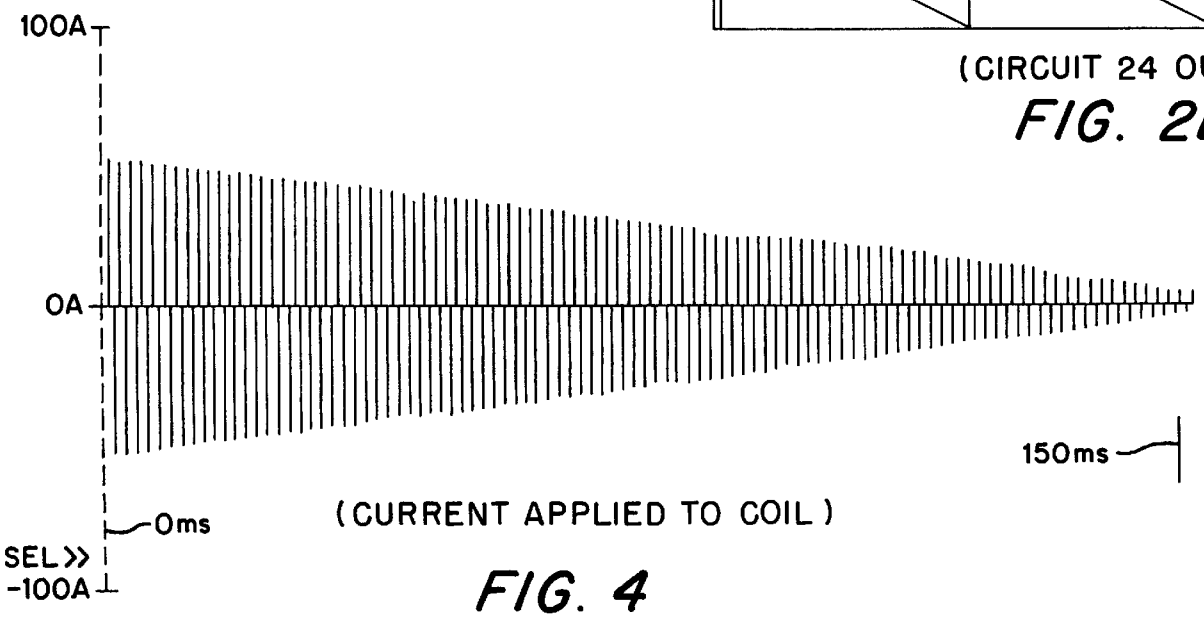
Figure 3E:
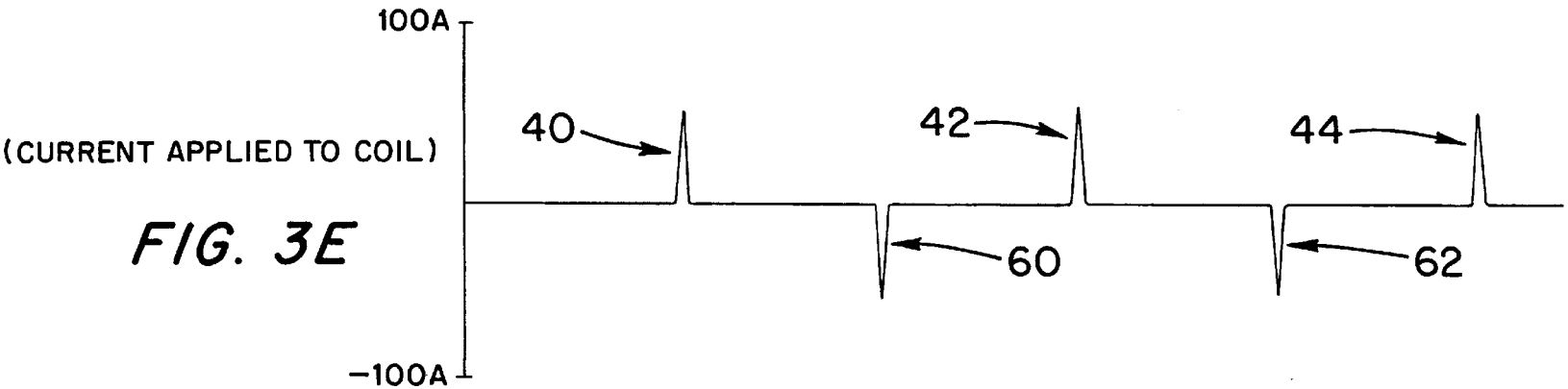

FIG. 4 shows, on a more compressed time scale, the current signal level trace of FIG. 3E. As seen from FIG. 4, a train of DC pulses is applied to the coil 10, the pulses having alternating polarities and a decreasing amplitude governed by the level of the declining ramp signal applied to the inverting inputs of the comparators 18, 20.

Circuitry for charging the capacitor 12 is not shown in the drawings, but may be like that disclosed in above-referenced U.S. Pat. No. 5,781,111. In the circuitry of the '111 patent, the storage capacitor is intermittently isolated from the deactivation coil, and during such periods is charged from a power line signal. In the present invention, alternate ones of the periods corresponding to the declining ramp signal may be used for charging, with the other periods utilized to generate the pulse trains illustrated in FIG. 4.

It will be recognized that the sequence of declining amplitude, alternating polarity DC pulses shown in FIG. 4 provides a magnetic field which will operate to degauss the bias magnet of a magnetomechanical EAS marker presented at the coil 10, and without requiring relative motion between the marker and the coil. The circuitry illustrated in FIG. 1 is expected to be highly energy efficient, since the duty cycle is quite low. In addition, the circuitry shown herein is relatively simple, and should therefore be economical to manufacture.

Figure 5:
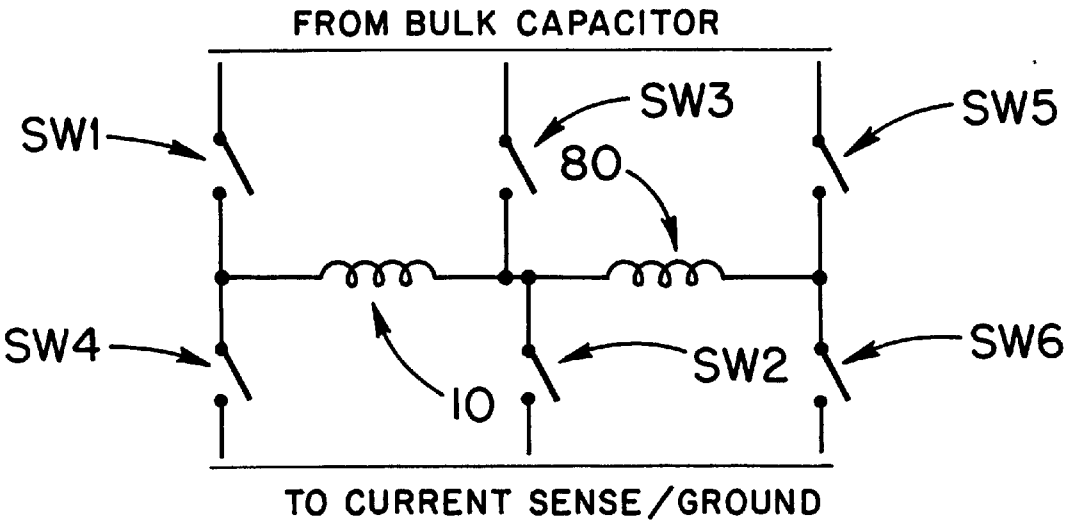
FIG. 5 is a schematic circuit diagram which illustrates a portion of the circuit of FIG. 1, when modified according to an alternative embodiment of the invention.

FIG. 5 illustrates an alternative to the one coil, four-switch arrangement shown in FIG. 1A. In the arrangement of FIG. 5, two coils and six switches are provided. With the arrangement of FIG. 5, two coils, possibly arranged with orthogonal orientations (as in an embodiment shown in FIG. 8 of co-pending patent application Ser. No. 09/016,175, filed Jan. 30, 1998, and commonly assigned with the present application), may be driven in alternating modes.

FIG. 5 shows the same coil 10 and switches SW1, SW2, SW3 and SW4 as shown in FIG. 1A. Also shown in FIG. 5 is a second coil 80, which has one terminal connected to the junction of switches SW3 and SW2. Switch SW5 is connected between the storage capacitor (not shown in FIG. 5) and the other terminal of coil 80, while switch SW6 is connected between the latter terminal of coil 80 and a third current sense circuit, which is not shown. All six switches may be transistor switches such as IGBT's.

In the first mode of operation of this embodiment of the invention, switches SW5 and SW6 are maintained in an open condition, so that coil 80 is effectively out of the circuit; switches SW1 through SW4 are operated in the same manner as described above in connection with FIGS. 2–4.

In the second mode of operating this embodiment of the invention, switches SW1 and SW4 are maintained in an open condition to effectively remove coil 10 from the circuit, and switches SW3, SW6, SW5 and SW2 are operated in like manner to the operations of switches SW1 through SW4 in the first mode.

Thus, in the first mode of operation, a pulse train like that of FIG. 4 is applied to coil 10, and in the second mode of operation a like pulse train is applied to coil 80. It will be understood that the apparatus is to be repeatedly switched between the first and second modes of operation at short intervals.

It is well within the ability of those who are skilled in the art to modify the control circuit of FIGS. 1B and 1C to implement the two modes of operation described above.

Various changes in the foregoing deactivation devices and modifications in the described practices may be introduced without departing from the invention. The particularly preferred embodiments of the invention are thus intended in an illustrative and not limiting sense. The true spirit and scope of the invention are set forth in the following claims.

What is claimed is:

1. Apparatus for deactivating a magnetomechanical EAS marker, the apparatus comprising:

a coil for generating a magnetic field to which the marker is to be exposed, said coil having a first terminal and a second terminal;

a storage capacitor;

a first switch connected between said storage capacitor and said first terminal of said coil;

a second switch connected between said second terminal of said coil and ground;

a third switch connected between said storage capacitor and said second terminal of said coil;

a fourth switch connected between said first terminal of said coil and ground; and control means for controlling said first, second, third and fourth switches, said control means causing said first and second switches to be open and said third and fourth switches closed during a first sequence of time intervals, and causing said third and fourth switches to be open and said first and second switches closed during a second sequence of time intervals interleaved with said first sequence of time intervals, and causing all of said first, second, third and fourth switches to be open during a third sequence of time intervals, a respective one of said third sequence of time intervals intervening between each sequential pair of intervals of said first and second sequences.

2. Apparatus according to claim 1, the respective durations of the intervals of said first sequence are monotonically decreasing over the course of said first sequence, and the respective durations of the intervals of said second sequence are monotonically decreasing over the course of said second sequence.

3. Apparatus according to claim 2, wherein said control means includes means for generating a ramp signal, comparison means for comparing a signal level representative of a current level in said coil with said ramp signal, and means, responsive to said comparison means, for selectively terminating said intervals of said first and second sequences.

4. Apparatus according to claim 1, further comprising at least one additional coil connected in series with said coil.

5. Apparatus according to claim 1, further comprising at least one additional coil connected in parallel with said coil.

6. Apparatus according to claim 1, wherein said intervals of said third sequence are substantially longer in duration than said intervals of said first sequence, and are substantially longer in duration than said intervals of said second sequence.

7. Apparatus according to claim 1, wherein each of said first, second, third and fourth switches is constituted by a transistor switch.

8. Apparatus according to claim 7, wherein each of said first, second, third and fourth switches includes an IGBT.

9. A method of deactivating a magnetomechanical EAS marker, the method comprising the steps of:

providing a coil;

applying a sequence of first DC pulses to said coil, said first pulses all of a first polarity;

applying a sequence of second DC pulses to said coil, said second pulses interspersed in time with said first pulses and of a second polarity opposite to said first polarity; and exposing said EAS marker to a magnetic field formed by said pulses in said coil;

wherein each of said second DC pulses is applied to said coil after a respective time period during which none of said first DC pulses is applied to said coil.

10. A method according to claim 9, wherein said first pulses monotonically decrease in amplitude over a time interval and said second pulses monotonically decrease in amplitude over said time interval.

11. A method according to claim 10, wherein said time interval is substantially 150 ms in duration.

12. A method according to claim 11, where said first pulses are applied at a frequency of substantially 500 Hz, and said second pulses are applied at said frequency of substantially 500 Hz.

13. Apparatus for deactivating a magnetomechanical EAS marker, the apparatus comprising:

a first coil having a first terminal and a second terminal;

a second coil having a third terminal and a fourth terminal, said third terminal connected to said second terminal, said coils for generating respective magnetic fields for deactivating the marker;

a storage capacitor;

a first switch connected between said storage capacitor and said first terminal;

a second switch connected between ground and a junction of said second and third terminals;

a third switch connected between said storage capacitor and said junction of said second and third terminals;

a fourth switch connected between ground and said first terminal;

a fifth switch connected between said storage capacitor and said fourth terminal;

a sixth switch connected between ground and said fourth terminal; and control means for controlling said first, second, third, fourth, fifth and sixth switches, said control means changing over between a first mode of operation and a second mode of operation;

in said first mode of operation said control means causing said first, second, fifth and sixth switches to be open and said third and fourth switches to be closed during a first sequence of time intervals, and causing said third, fourth, fifth and sixth switches to be open and said first and second switches closed during a second sequence of time intervals interleaved with said first sequence of time intervals, and causing all of said first, second, third, fourth, fifth and sixth switches to be open during a third sequence of time intervals, a respective one of said third sequence of time intervals intervening between each sequential pair of intervals of said first and second sequences; and in said second mode of operation said control means causing said first, third, fourth and sixth switches to be open and said second and fifth switches to be closed during a fourth sequence of time intervals, and causing said first, second, fourth and fifth switches to be open and said third and sixth switches to be closed during a fifth sequence of time intervals interleaved with said fourth sequence of time intervals, and causing all of said first, second, third, fourth, fifth and sixth switches to be open during a sixth sequence of time intervals, a respective one of said sixth sequence of time intervals intervening between each sequential pair of intervals of said fourth and fifth sequences.

14. Apparatus according to claim 13, wherein each of said first, second, third, fourth, fifth and sixth switches is constituted by a transistor switch.

15. Apparatus according to claim 14, wherein each of said first, second, third, fourth, fifth and sixth switches include an IGBT.

16. A circuit for selectively energizing a coil in a device for deactivating a magnetomechanical EAS marker, the circuit comprising:

a storage capacitor;

a first switch for selectively connecting the storage capacitor to a first terminal of the coil;

a second switch for selectively connecting the storage capacitor to a second terminal of the coil;

a first current sense circuit;

a third switch for selectively connecting the first terminal of the coil to the first current sense circuit;

a second current sense circuit;

a fourth switch for selectively connecting the second terminal of the coil to the second current sense circuit;

a first comparator;

means for supplying an output of said first current sense circuit to a first input of said first comparator;

a second comparator;

means for supplying an output of said second current sense circuit to a first input of said second comparator;

means for generating a declining-ramp signal;

means for supplying said declining-ramp signal in parallel to a second input of said first comparator and to a second input of said second comparator;

a first D-type flip-flop;

means for supplying an output of said first comparator to a clear input of said first D-type flip-flop;

means for applying a first clock signal to a clock input of said first D-type flip-flop;

means for supplying an output of said first D-type flip-flop in parallel as respective control signals to said second and third switches;

a second D-type flip-flop;

means for supplying an output of said second comparator to a clear input of said second D-type flip-flop;

means for applying a second clock signal to a clock input of said second D-type flip-flop; and means for supplying an output of said second D-type flip-flop in parallel as respective control signals to said first and fourth switches.

17. A circuit according to claim 16, wherein said first and second clock signals are at substantially the same frequency and are off-set in phase from each other by substantially 180°.

18. A circuit according to claim 17, wherein said frequency of said clock signals is substantially 500 Hz.

19. A circuit according to claim 16, wherein a respective inverted output of each of said flip-flops is connected to a D-input of the respective flip-flop.

20. A circuit according to claim 16, wherein each of said switches comprises a respective insulated-gate bipolar transistor.

* * * * *